US010502228B2

(12) United States Patent
Zauhar et al.

(10) Patent No.: US 10,502,228 B2
(45) Date of Patent: Dec. 10, 2019

(54) LOCKING FLYWHEEL BLADE

(71) Applicant: Chien Luen Industries Co., Ltd., Inc., Oakland Park, FL (US)

(72) Inventors: Zachary Zauhar, Dania Beach, FL (US); Francisco Biancuzzo, Fort Lauderdale, FL (US); Eliezer Rivera, Plantation, FL (US); Tien S. Lowe, Cooper City, FL (US)

(73) Assignee: CHIEN LUEN INDUSTRIES CO., LTD., INC., Oakland Park, FL (US)

( * ) Notice: Subject to any disclaimer, the term of this patent is extended or adjusted under 35 U.S.C. 154(b) by 561 days.

(21) Appl. No.: 15/278,842

(22) Filed: Sep. 28, 2016

(65) Prior Publication Data

US 2017/0037869 A1 Feb. 9, 2017

Related U.S. Application Data

(63) Continuation of application No. PCT/US2015/002208, filed on Mar. 23, 2015.

(60) Provisional application No. 61/971,740, filed on Mar. 28, 2014.

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 29/34
See application file for complete search history.

(56) References Cited

U.S. PATENT DOCUMENTS

| | | | |
|---|---|---|---|
| 686,211 | A | 11/1901 | Dowson |
| 1,485,552 | A | 3/1924 | Colby |
| 1,935,314 | A | 11/1933 | Finch |
| 2,395,193 | A | 2/1946 | Place |
| 4,396,352 | A | 8/1983 | Pearce |
| 5,180,284 | A | 1/1993 | Monrose, III |
| 5,372,480 | A | 12/1994 | Van Meter |

(Continued)

OTHER PUBLICATIONS

Chien Luen Industries Co., Ltd., Inc. et al, PCT Patent Application No. PCT/US2015/022008 filed on Mar. 23, 2015, International Search Report dated Jun. 30, 2015, 15 pages.

(Continued)

*Primary Examiner* — Woody A Lee, Jr.
(74) *Attorney, Agent, or Firm* — Brian S. Steinberger; Hilary F. Steinberger; Law Offices of Brian S. Steinberger, P.A.

(57) ABSTRACT

Systems, devices, apparatus and methods for easily attaching and detaching blades to flywheels/rotors on motors by inserting tab portions of the root ends of the blades into sockets on the flywheel/rotor. Inserting the root end of the blades into the slots causes raised ridges to slide into and snapably lock into grooves, which automatically locks the blades to the flywheel/rotor on the ceiling fan. Bending or pulling or pushing a free end of a sheath separates the ridge from the groove which allows the root ends of the blades to be released and easily pulled out from the sockets. Another embodiment has two free ends which can be pinched or pushed together with a hinge portion between, that also separates ridges from grooves, and allows the blades to be pulled from the flywheel.

26 Claims, 17 Drawing Sheets

(56) References Cited

U.S. PATENT DOCUMENTS

| | | | | |
|---|---|---|---|---|
| 5,927,945 | A | 7/1999 | Chen | |
| 5,944,486 | A | 8/1999 | Hodgkins, Jr. | |
| 5,980,353 | A | 11/1999 | Wu | |
| 6,027,310 | A | 2/2000 | Kerr, Jr. | |
| 6,059,531 | A | 5/2000 | Tai | |
| 6,139,276 | A | 10/2000 | Blateri | |
| 6,149,388 | A | 11/2000 | Liao | |
| 6,171,059 | B1 * | 1/2001 | Bucher | F04D 25/088 403/328 |
| 6,210,117 | B1 | 4/2001 | Bucher | |
| 6,378,824 | B1 | 4/2002 | Tseng | |
| 6,382,918 | B1 | 5/2002 | Tang | |
| 6,494,682 | B1 | 12/2002 | Blateri | |
| 6,676,376 | B2 | 1/2004 | Kerr, Jr. | |
| 6,688,850 | B2 | 2/2004 | Bucher | |
| 6,699,014 | B1 * | 3/2004 | Lam | F04D 25/088 416/210 R |
| 6,726,453 | B1 | 4/2004 | Hsieh | |
| 7,008,192 | B2 * | 3/2006 | Hidalgo | F04D 25/088 416/206 |
| 7,134,844 | B2 | 11/2006 | Robin | |
| RE39,448 | E | 12/2006 | Wu | |
| 7,857,592 | B2 | 12/2010 | Bucher | |
| 8,047,794 | B2 | 11/2011 | Wang | |
| RE43,629 | E | 9/2012 | Wu | |
| 8,337,162 | B2 | 12/2012 | Bucher | |
| 9,651,058 | B1 * | 5/2017 | Mares | F04D 29/34 |
| 2003/0219340 | A1 | 11/2003 | Hidalgo | |

OTHER PUBLICATIONS

Article 19 Amendments to PCT Application US2015/02208 filed Jul. 24, 2015. 17 pages with fax cover sheet.

PCT Notification concerning transmittal of copy of International Preliminary Report on Patentability for PCT Application 2015102208, dated Oct. 13, 2016, 13 pages.

* cited by examiner

Fig. 5C
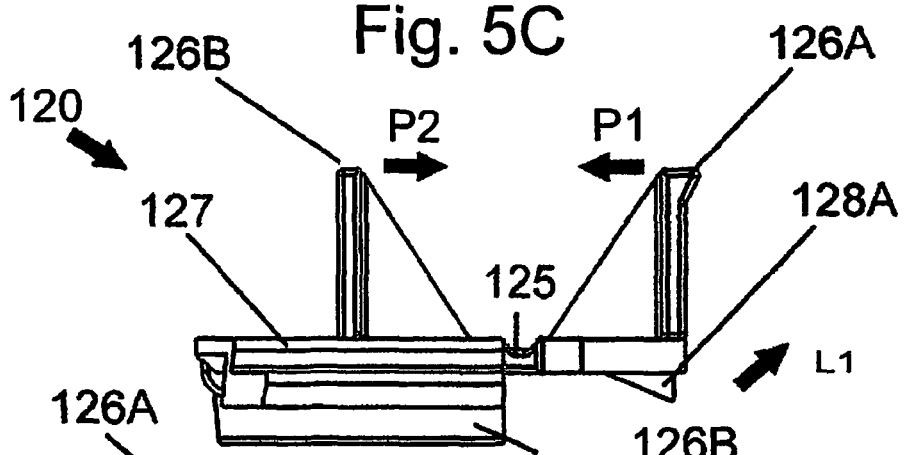
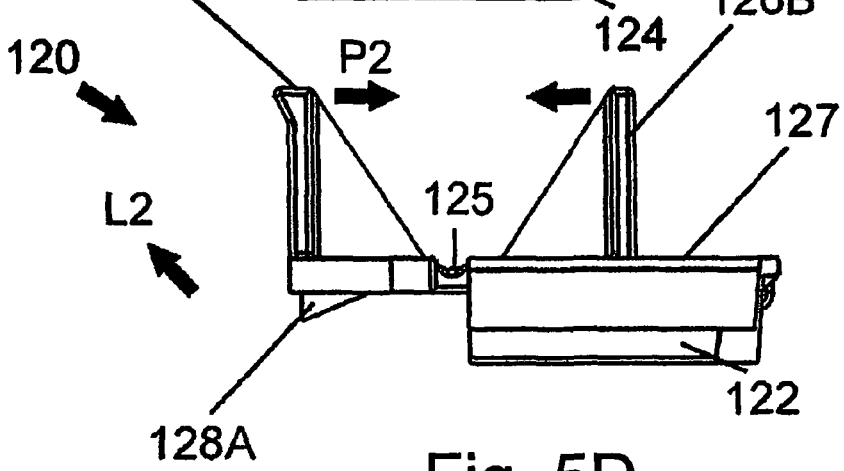
Fig. 5D

LOCKING FLYWHEEL BLADE

This application is a Continuation of PCT/US2015/02208 filed Mar. 23, 2015, which claims the benefit of U.S. Provisional Patent Application Ser. No. 61/971,740 filed Mar. 28, 2014. The entire disclosure of each of the applications listed in this paragraph are incorporated herein by specific reference thereto.

FIELD OF INVENTION

This invention relates to ceiling fans, and in particular to systems, devices, apparatus and methods for attaching and detaching blades to flywheels/rotors on motors by inserting root ends of blades into sockets/slots on a flywheel/rotor and snapably locking the blades in place by bendable catches that lock into grooves on the root ends of the blades, and allowing the blades to be removed by pulling up a tab or tabs to unlock the catches.

BACKGROUND AND PRIOR ART

Ceiling fans primarily have blades that are attached to the motor housing brackets by multiple screws and the like. Screwing the blades onto a ceiling mounted motor is not only difficult to accomplish, but results in most ceiling fans in the market place having visible screws that are unsightly. Furthermore, the underside locations of the fastener screws detract from the appearance of the ceiling fan itself. Another problem is from the ceiling fans having to run under continuous vibration conditions where the screws can loosen causing the blades to be accidentally released and result in damages to surrounding property and people in the vicinity.

Furthermore, ceiling fan blades need to be cleaned to remove dirt and dust buildup. Current techniques have relied on manually holding brushes to the blades themselves which inherently tires the muscles in the cleaner's neck, shoulders, arms and hands. This messy cleaning with brushes causes the dirt to fall on both the cleaner and furniture and flooring below the fan.

Thus, the need exists for a solution to the above problems with the prior art.

SUMMARY OF THE INVENTION

A primary objective of the present invention is to provide systems, devices, apparatus and methods for attaching and detaching blades to flywheels/rotors on ceiling fan motors by inserting root ends of blades into sockets/slots on a flywheel/rotor, and locking the blades in place by bendable catches.

A secondary objective of the present invention is to provide systems, devices, apparatus and methods for attaching and detaching blades to flywheels/rotors on ceiling fan motors by an installer without using fasteners, such as screws during installation.

A third objective of the present invention is to provide systems, devices, apparatus and methods for snapaby attaching blades to flywheels/rotors on ceiling fans.

A fourth objective of the present invention is to provide systems, devices, apparatus and methods for consistently attaching blades in correct orientations to flywheels/rotors on ceiling fans.

A fifth objective of the present invention is to provide to systems, devices, apparatus and methods for detaching blades from flywheels/rotors on ceiling fan motors by bending or pulling or pushing up a tab or pinching tabs to allow the blades to be released and freely removed.

An embodiment of the ceiling fan with locking flywheel blade(s) can include a ceiling fan motor having a rotatable flywheel, a plurality of slots through outer side edges of the flywheel, a plurality of fan blades having root ends, and catch members adjacent to each of the slots for allowing the root ends of the blades to be automatically locked to the rotatable flywheel by inserting the root ends of the blades through the sockets of the rotatable flywheel.

The catch members can include sheaths attached adjacent to each of the slots, wherein the root ends of the blades become locked to the sheaths when the root ends of the blades are inserted into each of the slots, and locked in place by the catch members.

The root ends of each blade can include a groove for catching into a raised ridge on an inner surface of each sheath.

The root ends of each blade can include a raised ridge for catching into a groove on an inner surface of each sheath.

Each sheath can include a fixed edge and a free end, wherein bending the free end removes the raised ridge from the groove, and allows the blade to be released and freely pulled out from the slot, where the free end can be a tab.

Each sheath can include a fixed edge and a free end, wherein bending the free end removes the raised ridge from the groove, and allows the blade to be released and freely pulled out from the slot, where the free end can be a tab.

Each sheath is fixably attached to the flywheel during manufacturing of the ceiling fan, by one or more screw fasteners.

The root end of the blade and the sheath can include a longitudinal groove that is slidable into a longitudinal ridge which prevents installers from installing the blades upside down.

Each sheath can include a first free end and a second free end separated by one another by a hinge portion, wherein pinching and bending the first free end and the second free end together separates the raised ridge from the groove, and allows the blade to be released and freely pulled out from the slot.

Each sheath can include a first free end and a second free end separated by one another by a hinge portion, wherein pinching and bending the first free end and the second free end together separates the raised ridge from the groove, and allows the blade to be released and freely pulled out from the slot.

A method of assembling blades to a ceiling fan, can include the steps of providing a ceiling fan motor with a rotatable flywheel, providing a plurality of slots through outer side edges of the flywheel, inserting root ends of the blades into the slots, and snapably locking the blades to the flywheel by snapping catch members into grooves.

The locking step can includes the steps of providing a groove on each root end of the blades, providing a raised ridge on an inner surface of the sheaths, and snapably locking the raised ridge into each groove after pushing the root ends of the blades through the slots.

The locking step can include the steps of providing a groove on an inner surface of each sheath, providing a raised ridge on each root end of the blades, and snapably locking the raised ridge into each groove after pushing the root ends of the blades through the slots.

The method can include the step of releasing the blades from the slots by bending a free end portion of the sheaths which removes the raised ridge from the groove, and allows the blades to be freely pulled out from the slots.

The method can further include the step of preventing the blades from being installed upside down by a sliding a longitudinal ridge into a longitudinal groove.

The method can further include the step of releasing the blades from the slots by pinching the first free end and the second free end together on opposite sides of a hinge portion, which separates the raised ridge from the groove, and allows the blades to be released and freely pulled out from the slots.

Further objects and advantages of this invention will be apparent from the following detailed description of the presently preferred embodiments which are illustrated schematically in the accompanying drawings.

BRIEF DESCRIPTION OF THE FIGURES

FIG. 5C is a left side view of the sheath of FIG. 5A.

FIG. 5D is a right side view of the sheath of FIG. 5A.

DESCRIPTION OF THE PREFERRED EMBODIMENTS

Figure 1A:
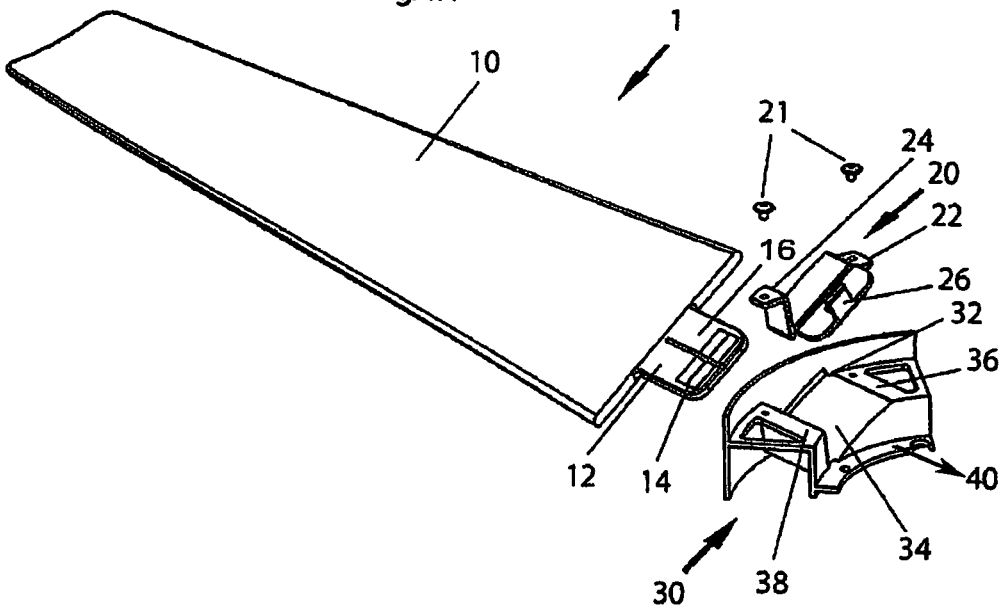
FIG. 1A is an exploded view of a blade with sheath and flywheel that attaches to rotor on ceiling fan motor.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components is described below.

1. blade and flywheel attachment embodiment
10. blade
12. root end of blade
14. grooves on root end
16. longitudinal groove on root end
20. sheath with fastener edges
21. fastener(s)/screws
22. lower fastening edge
24. upper fastening edge
25. upper horizontal groove (hinge portion)
26. pull tab
27. sheath member
28. raised triangle shaped ridges underneath
30. flywheel
32. narrow slot(slit) in outer side of flywheel
34. sloped/inclined surface
36. lower ledge
38. upper ledge
40. rotor on ceiling fan motor
100. Second embodiment blade and flywheel attachment embodiment
110. second embodiment blade
112. root end of blade
114. grooves on root end
116. longitudinal groove on root end
120. second embodiment sheath with fastener edges
121. fastener(s)/screws
122. first fastening surface
124. second fastening surface
125. upper horizontal groove (hinge portion)
126A. Front pull tab
126B Rear pull tab
127. sheath member
128A. Front underneath raised triangle shaped ridge
128B Front underneath raised triangle shaped ridge
129 longitudinal alignment ridge for longitudinal groove 116
130. flywheel
132. narrow slot(slit) in outer side of flywheel
134. sloped/inclined surface
136. lower fastening surface
138. upper fastening ledge
140. rotor on ceiling fan motor

FIRST EMBODIMENT

Figure 1B:
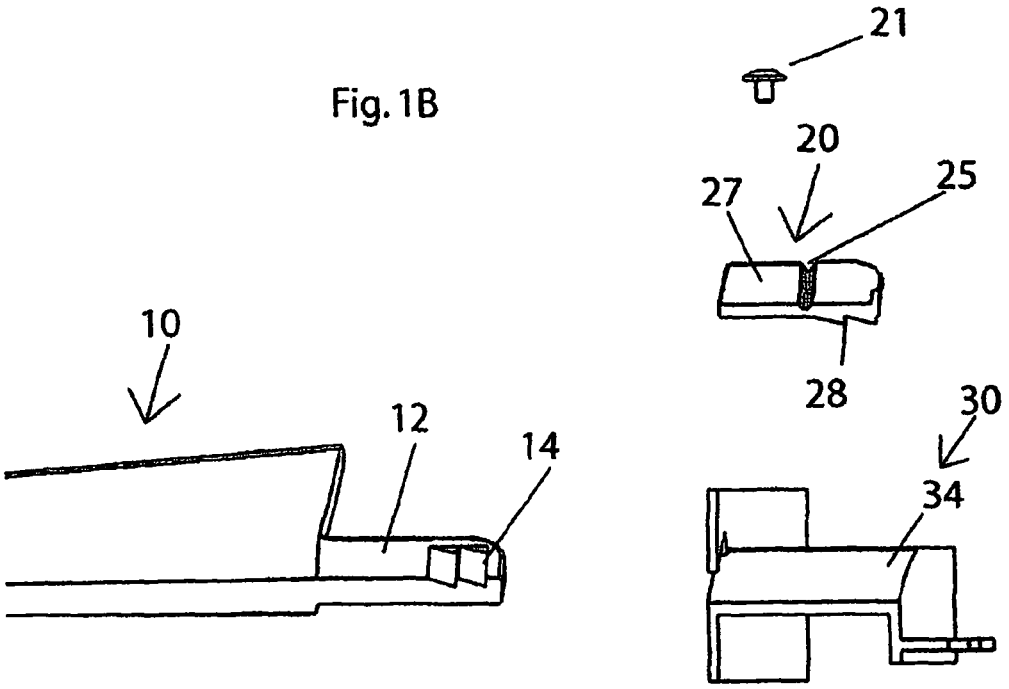
FIG. 1B is a cross-sectional view of the blade, root end, sheath and flywheel of FIG. 1A.

FIG. 1A is an exploded view 1 of a blade 10 with sheath 20 and flywheel 30 that attaches to rotor 40 on ceiling fan motor. FIG. 1B is a cross-sectional view of the blade 10 with root end 12 having horizontal triangular shaped groove(s) 14 in an upper surface and longitudinal groove 16 perpendicular to the longitudinal axis of the blade 10, sheath 20 and flywheel 30 with slide slot(slit) 32 and sloped/inclined surface 34 of FIG. 1A.

Lower fastening edge 22 of sheath 20 attaches to lower ledge 36 on the flywheel 30 with a fastener 21, and upper fastening edge 24 of sheath 20 attached to upper ledge 38 with another fastener 21. The attached sheath 20 on the flywheel 30 forms a channel between sheath member 27 and sloped/inclined surface 34 of the flywheel 30.

Figure 2:
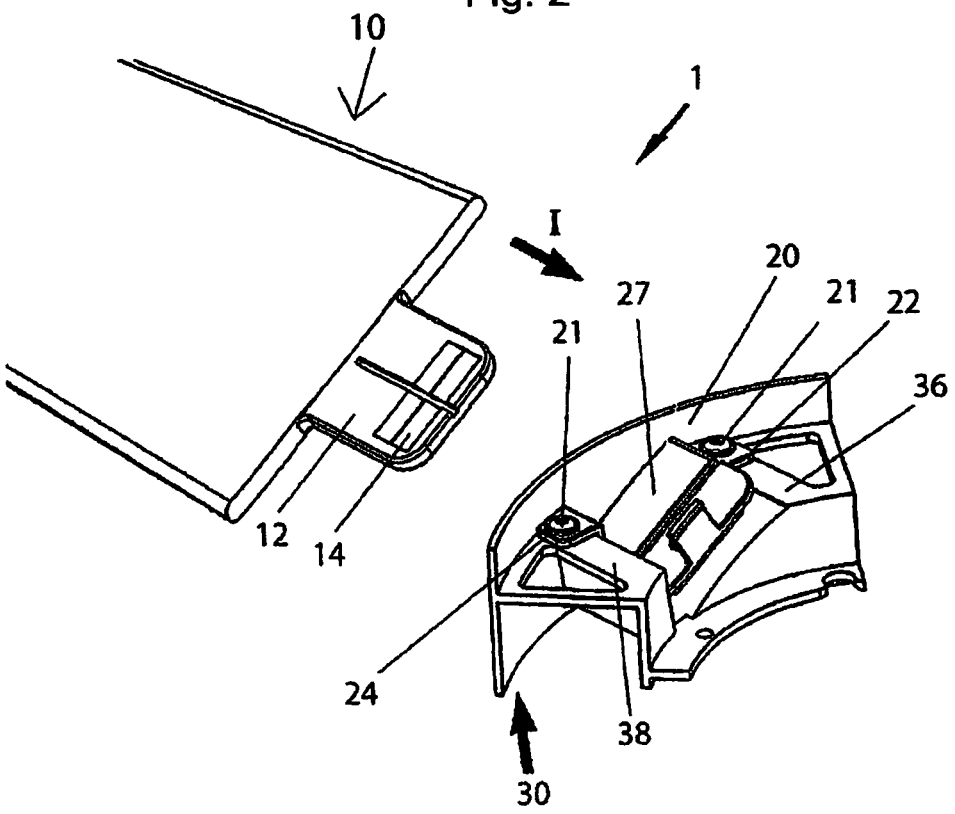
FIG. 2 shows the sheath fastened by screw type fasteners to the flywheel of FIGS. 1A-1B with blade ready to be installed.

FIG. 2 shows the sheath 20 fastened by screw type fasteners 21 to the flywheel 30 of FIG. 1 with root end 12 of blade 10 ready to be installed by being inserted in the direction of arrow I into slot 32 (shown in FIG. 1A. The outer end of the root end 12 of the blade 10 can push the triangular ridges 28 upward until they snap in place into grooves 14 on the root end 12 of the blade 10. The sheath 20 can be pre-attached at the factory before being shipped out, so that installers (and/or customers) onsite only need to insert the root end 12 of the blades 10 into the slots (slits) 31 on the outer sides of the flywheels 30 attached to the rotors of the ceiling fan motor. Here, no fasteners need to be used onsite to assemble or disassemble the blades from the ceiling fan motor.

Figure 3A:
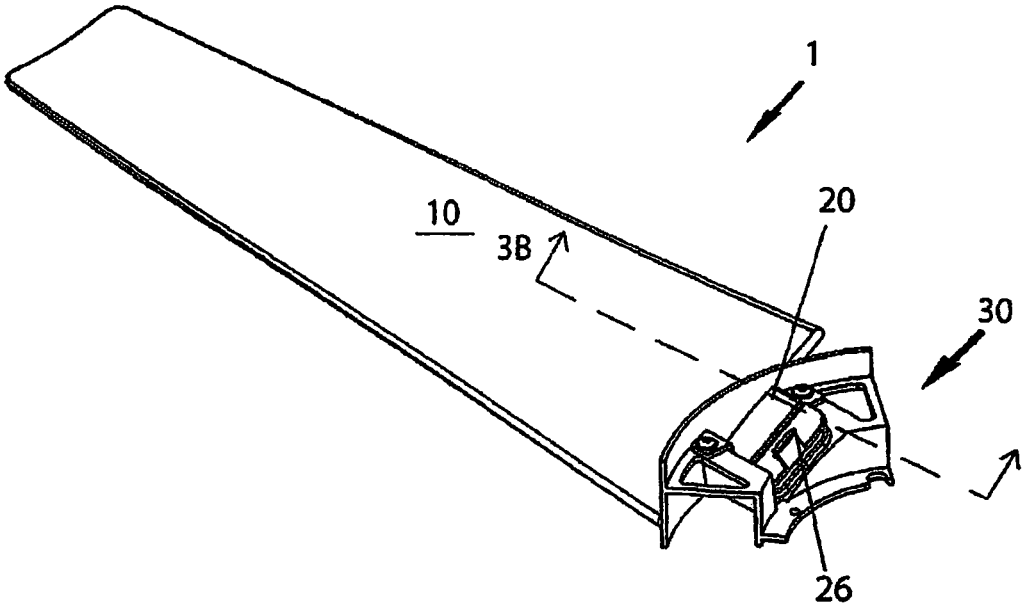
FIG. 3A is an assembled view of the root end of the blade slid into the slot on the outside of the flywheel and locked in place by the sheath of FIG. 2.

FIG. 3A is an assembled view of the root end 12 of the blade 10 slid into the slot 31 on the outside of the flywheel 30 and locked in place by the lower facing raised triangle shaped ridges underneath sheath member 27 of FIG. 2.

Figure 3B:
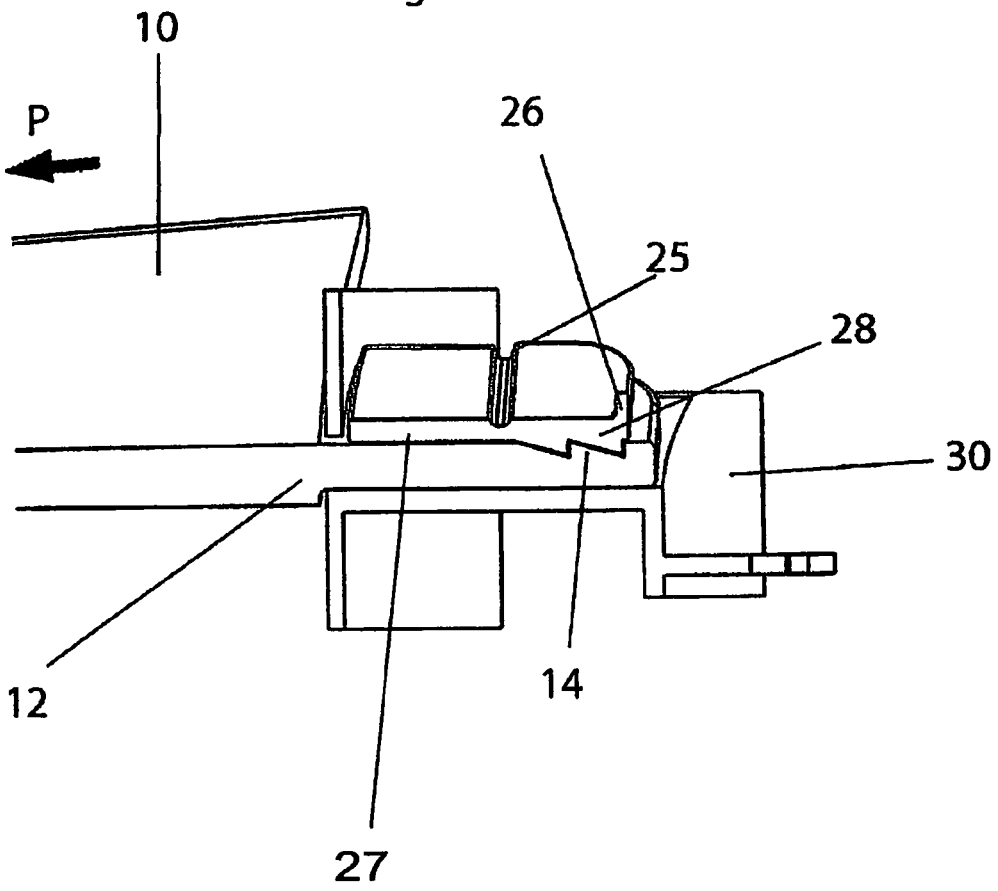
FIG. 3B is a cross-sectional view of the assembled blade in the slot of the flywheel being held in place by the sheath.

FIG. 3B is a cross-sectional view of the assembled root end 12 of the blade 10 in the slot 31 of the flywheel 30 being held in place by the sheath 20. The horizontal grooves 14 can line up with the ridges 28 in the sheath securing and locking the blade so that the blade 10 cannot be pulled out from the flywheel. The stepped triangle shaped grooves 14 in the root end 12 of the blade are locked in place by mateably attached to the raised triangle ridges 28 under the sheath member 27. The embodiment also allows for a single vertical groove 16 in the root end 12 of the blade 10 that can mate with a longitudinal ridge under the sheath 20 for aligning the root end 12 into the slot 32 of the flywheel 30 and preventing the installer from installing the blade(s) 10 upside down.

To be removed the tab 26 is pulled upward (where the groove 25 allows for a living hinge bend) allowing the raised ridges 28 to lift out of the groove(s) 14 so that the blade 10 can be pulled in the direction of arrow P from flywheel 30.

The novel sheath can be made from molded plastic, and the like, as a single part piece or more than part attached together.

While the embodiment shows a longitudinal groove on the root end of the blade that slidable into a mating longitudinal ridge in the sheath to help align the blades in position within the slot/socket on the flywheel, the longitudinal ridge can be on the root end of the blades and the longitudinal groove can be inside of the sheath.

Although the embodiment shows the downwardly protruding triangular ridges underneath the sheath and the grooves on the root end of the blades, the invention can work with the grooves under the sheath member with the triangular ridges on the root ends of the blades.

SECOND EMBODIMENT

Figure 4A:
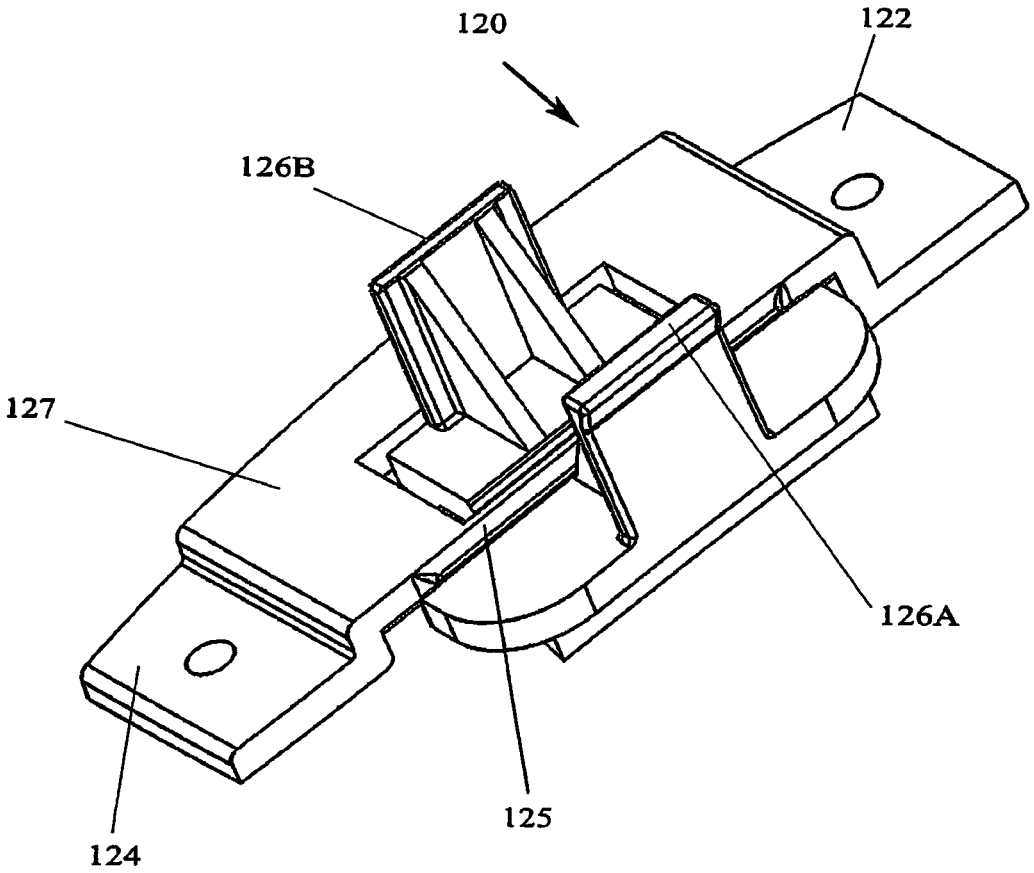
FIG. 4A is an upper front perspective view of another sheath embodiment.
Figure 4B:
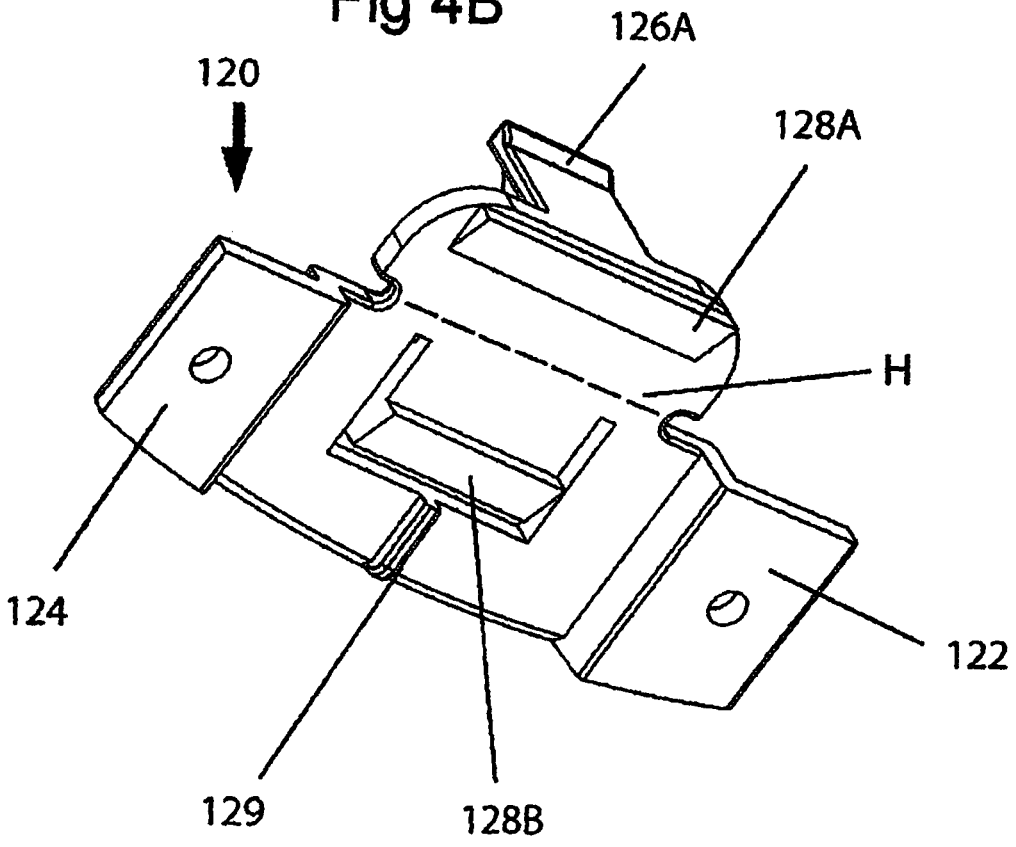
FIG. 4B is a lower front perspective view of the sheath of FIG. 4A.
Figure 4C:
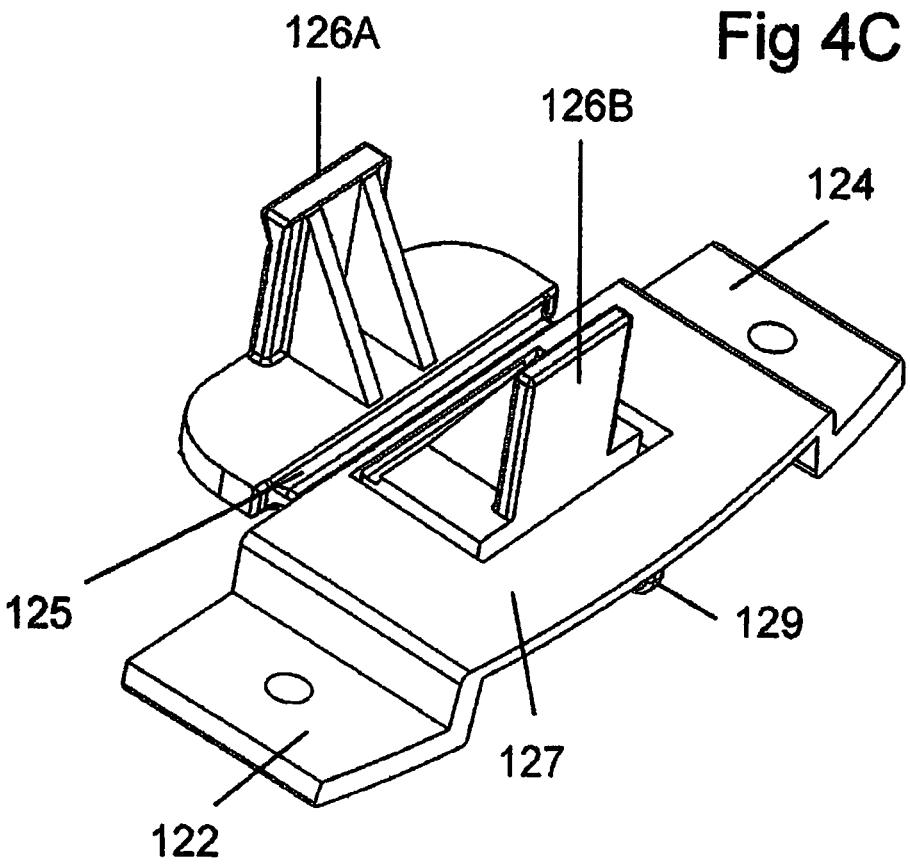
FIG. 4C is an upper rear perspective view of the sheath of FIG. 4A.
Figure 4D:
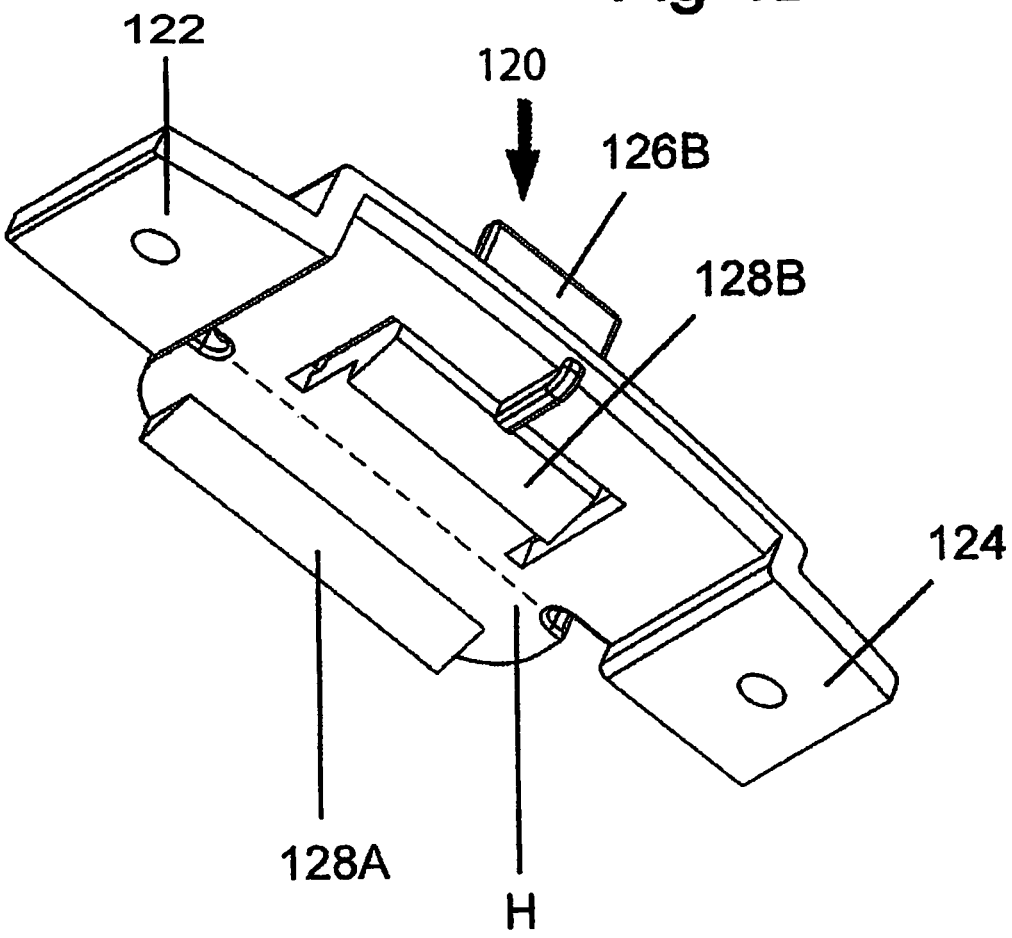
FIG. 4D is a lower rear perspective view of the sheath of FIG. 4A.

FIG. 4A is an upper front perspective view of another sheath embodiment 120. FIG. 4B is a lower front perspective view of the sheath 120 of FIG. 4A. FIG. 4C is an upper rear perspective view of the sheath 120 of FIG. 4A. FIG. 4D is a lower rear perspective view of the sheath 120 of FIG. 4A.

Figure 5A:
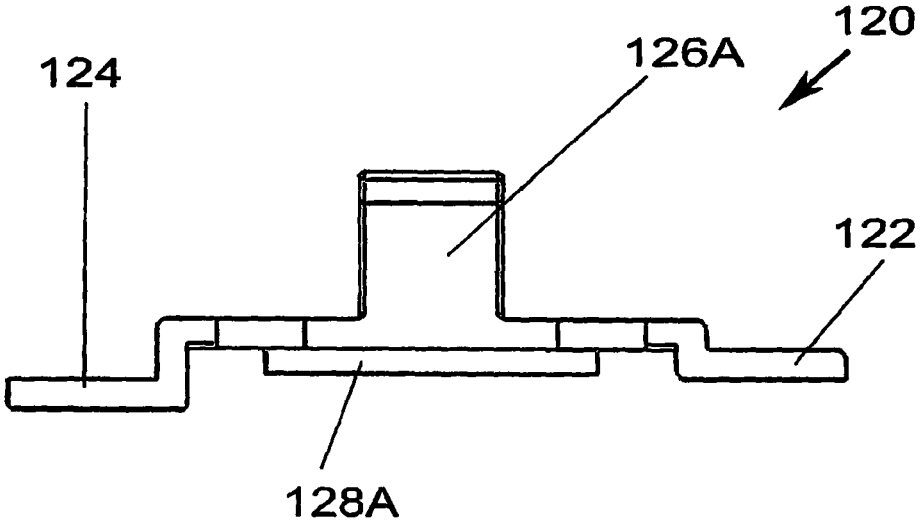
FIG. 5A is a front view of the sheath of FIG. 4A.
Figure 5B:
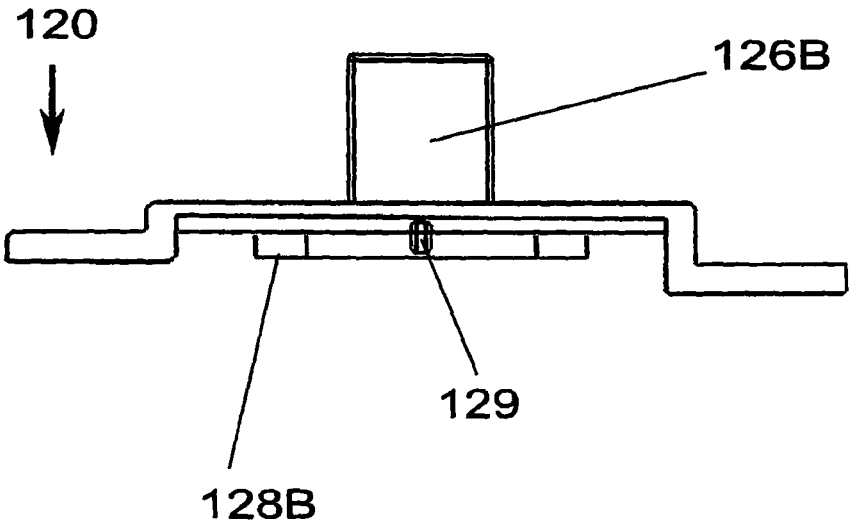
FIG. 5B is a rear view of the sheath of FIG. 5A.
Figures 5E, 5F:
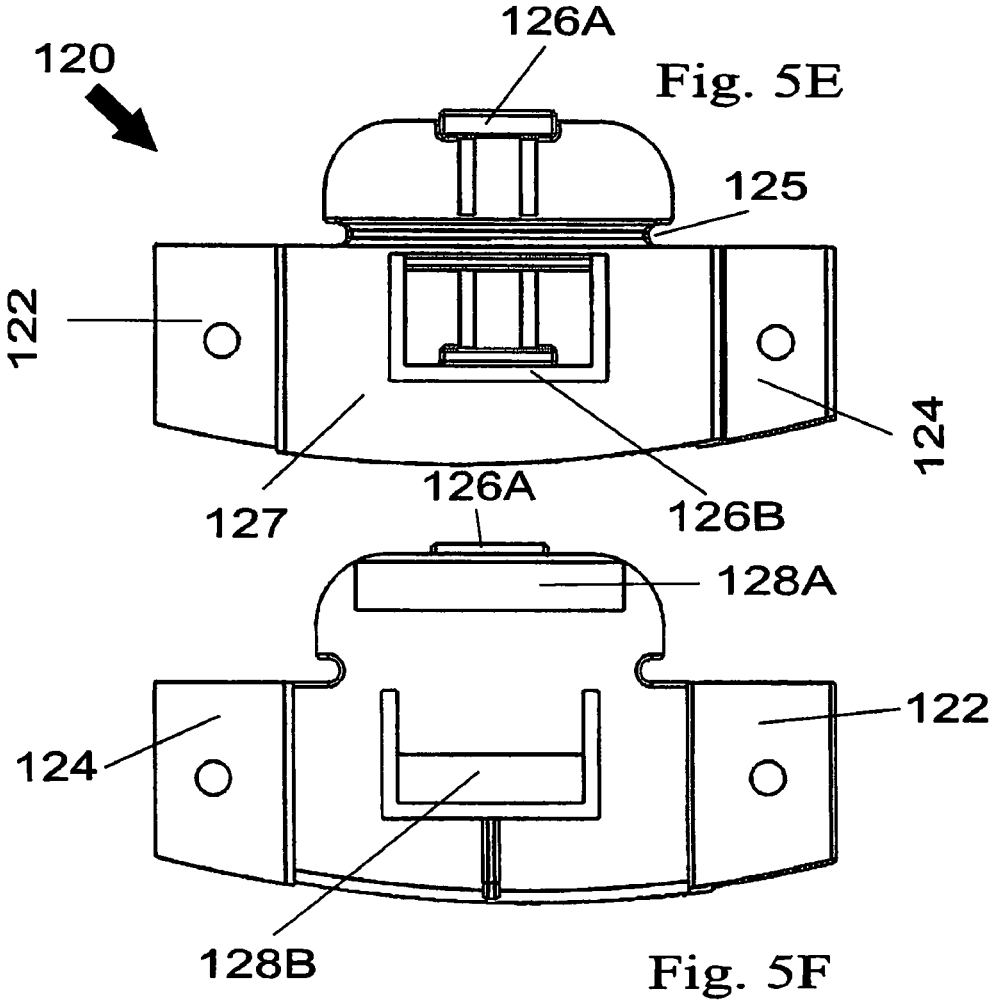
FIG. 5E is a top view of the sheath of FIG. 5A.
FIG. 5F is a bottom view of the sheath of FIG. 5A.

FIG. 5A is a front view of the sheath 120 of FIG. 4A. FIG. 5B is a rear view of the sheath 120 of FIG. 5A. FIG. 5C is a left side view of the sheath 120 of FIG. 5A. FIG. 5D is a right side view of the sheath 120 of FIG. 5A. FIG. 5E is a top view of the sheath 120 of FIG. 5A. FIG. 5F is a bottom view of the sheath 120 of FIG. 5A.

Referring to FIGS. 4A-5F, sheath 120 can include a first fastening surface 122 on one side, and a second fastening surface 124 at an opposite end of the main sheath member 127. On top of the sheath can be a bendable upwardly protruding front pull tab 126A separated by a hinge groove 125 in the sheath member 17 from a bendable upwardly protruding rear pull tab 126B. Below the front pull tab 126A can be a downwardly protruding front triangle ridge 128A, and below the rear pull tab 126B can be a downwardly protruding rear triangle ridge 128B. Groove 125 forms a living hinge that allows a temporary fold along the groove 125 during the blade installation, and the blade release which will be described below. A longitudinal alignment ridge 129 is underneath the rear of the sheath 120.

Figure 6A:
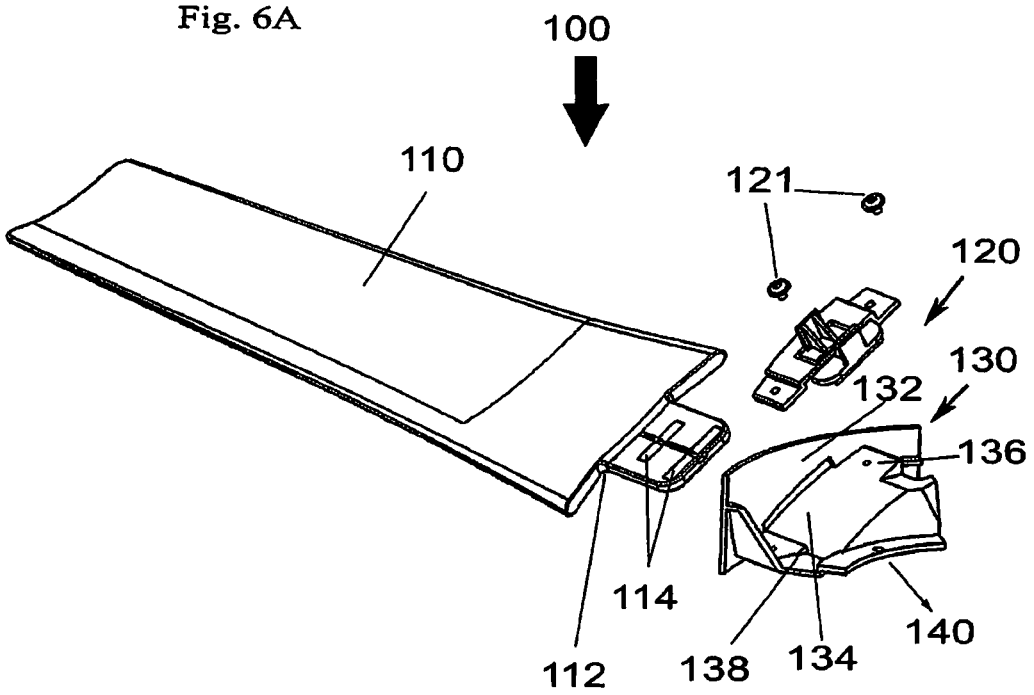
FIG. 6A is an exploded view of a blade with sheath of FIGS. 4A-5F and flywheel that attaches to rotor on ceiling fan motor.
Figure 6B:
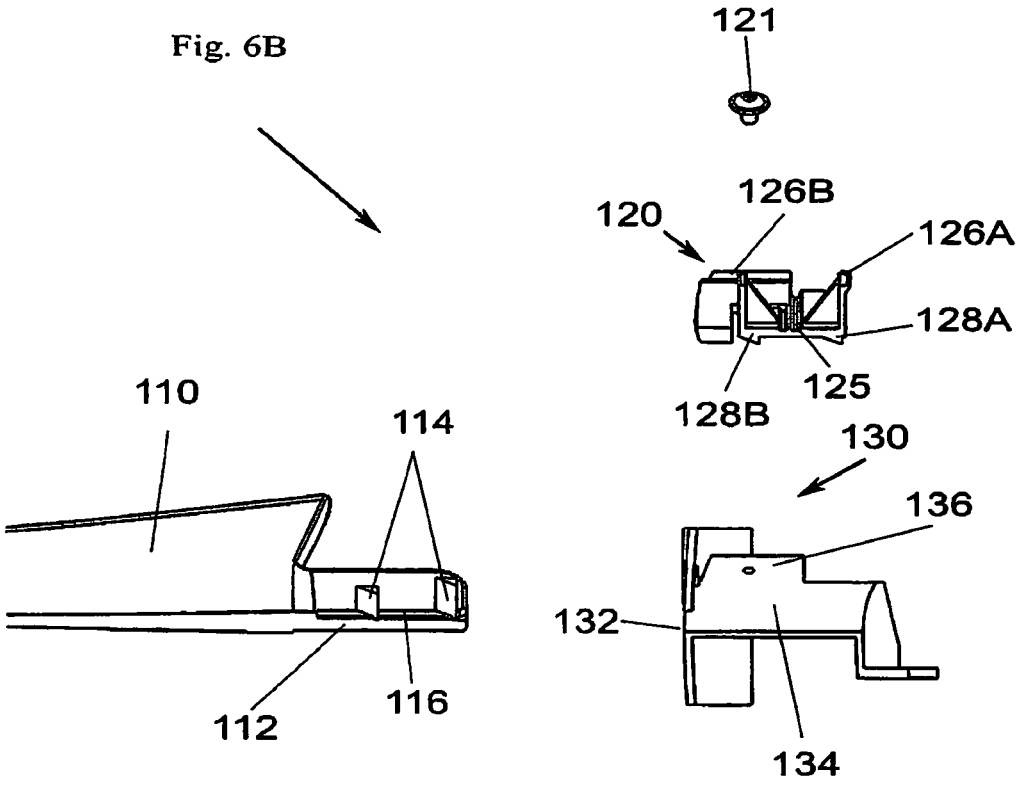
FIG. 6B is a cross-sectional view of the blade, root end, sheath and flywheel of FIG. 6A.

FIG. 6A is an exploded view of a blade 110 with sheath 120 of FIGS. 4A-5F and flywheel 130 that attaches to rotor 140 on ceiling fan motor. FIG. 6B is a cross-sectional view of the blade 110 with root end 112, sheath 120 and flywheel 130 of FIG. 6A.

Figure 7:
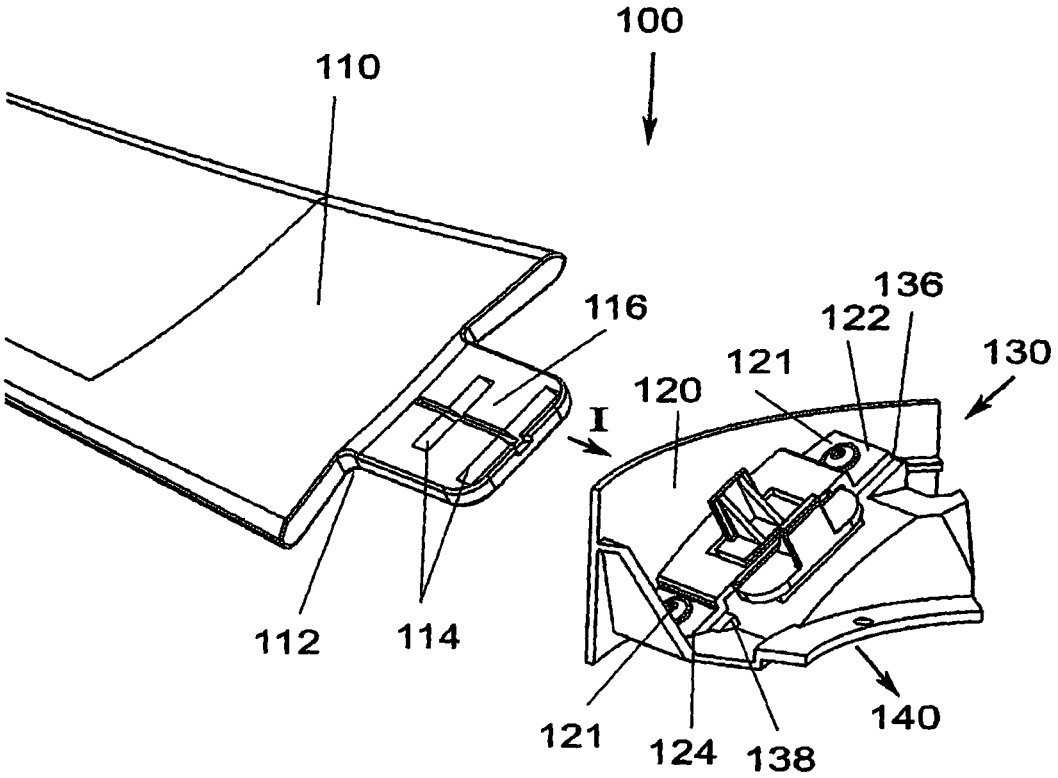
FIG. 7 shows the sheath fastened by screw type fasteners to the flywheel of FIGS. 6A-6B with blade ready to be installed.

FIG. 7 shows the sheath 120 fastened by screw type fasteners 121 to the flywheel 130 of FIGS. 6A-6B with blade 110 ready to be installed.

Figure 8A:
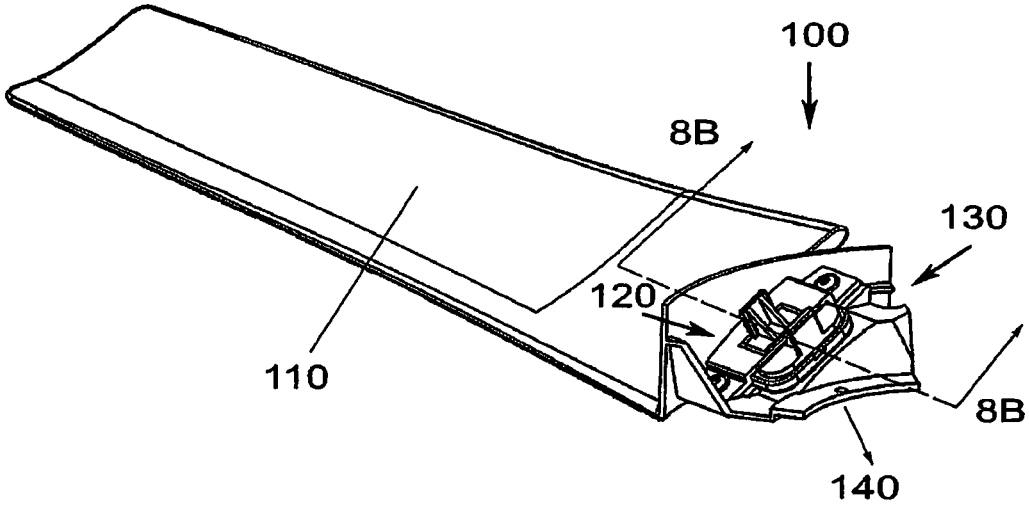
FIG. 8A is an assembled view of the root end of the blade slid into the slot on the outside of the flywheel and locked in place by the sheath of FIG. 7.
Figure 8B:
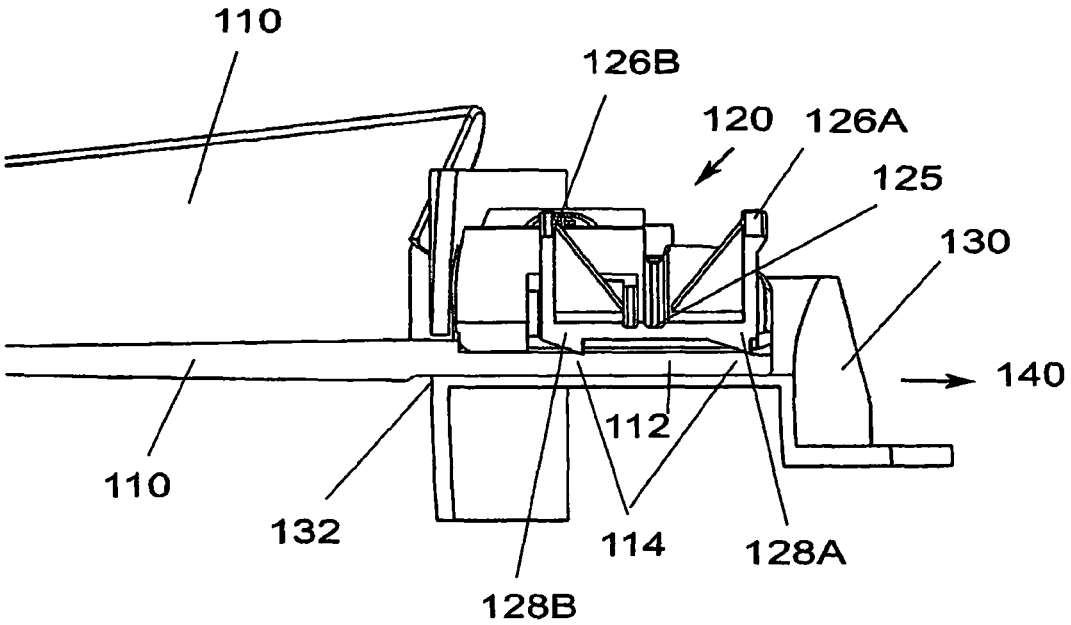
FIG. 8B is a cross-sectional view of the assembled blade in the slot of the flywheel being held in place by the sheath, shown in FIG. 8A along arrows 8B.

FIG. 8A is an assembled view of the root end 112 of the blade 110 after being slid into the slot/slit 132 on the outside of the flywheel 130 and locked in place by the bendable downwardly protruding triangular ridges 128A, 128B (shown in FIG. 6B) under sheath 120 of FIG. 7. FIG. 8B is a cross-sectional view of FIG. 8B along arrows 8B, showing the assembled blade 110 in the slot 132 of the flywheel 130 being held in place by the sheath 120.

Referring to FIGS. 4A-7, to install the sheath 120, the installer can position first fastening end 122 to fastening surface 136 on the flywheel 130, and position second fastening end 124 to the other fastening surface 138, and use the fasteners 121, such as screws to screwably attach the sheath 120 in place. This installation can be done at the factory, or be part of a kit to be attached by the ceiling fan installer.

To attach the blade(s) 110 in place with the flywheel 30, reference is made to FIGS. 4A-8B. Before hanging the ceiling fan, the installer can position the root end 112 of each blade 110, separately, to be inserted in the direction of arrow I, into the side slot/slit 132 on the flywheel 130 that is attached to a rotor 140 on a ceiling fan motor. The longitudinal ridge 129 under the sheath member 127 passes into the longitudinal groove 116 on the root end 112 of the blade 110 to align the root end 112 of the blade 110 into the side slit/slot 132 on the flywheel 130. The longitudinal groove 116 and longitudinal ridge 129 further prevents the installer from installing the blade(s) 110 upside down.

The exterior end of the root end 112 of the blade 110 pushes up the angled sides of downwardly extending triangular ridges 128A, 128B under the main sheath member 127 until the triangular ridges snap in place into the pair of parallel grooves 114 on the root end of the blade 110, locking the blade 110 in place, by the catch caused by the triangular ridges snapped into grooves 114.

Each of the other blades can be similarly locked in place to the flywheel 130 in a similar manner by using similar bendable catches.

To remove the blade 110, the installer can pinch together the upwardly protruding pull tabs 126A, 126B toward each other in the direction of arrows P1, P2, shown in FIGS. 5C-5D, and also shown in FIG. 8B, which causes the triangular ridges 128A, 128B to lift up in the direction of arrows L1, L2, relative to the hinge groove 125 pulling the ridges 128A, 128B out of the parallel grooves 114. This allows the installer to use one of their second hands to grab onto the blade and to pull the blade 110 outward from the flywheel 120 in the opposite direction to arrow I.

Each of the other blades of the ceiling fan can be removed from the flywheel of the ceiling fan accomplished in a similar manner, by releasing the other bendable catches.

Although the preferred embodiment shows the groove(s) on the root ends of the blades and the raised ridge inside of the sheaths, the groove(s) can be inside of the sheaths and the ridge portion on the root ends of the blades.

While the embodiment shows a longitudinal groove on the root end of the blade that slidable into a mating longitudinal ridge in the sheath to help align the blades in position within the slot/socket on the flywheel, the longitudinal ridge can be on the root end of the blades and the longitudinal groove can be inside of the sheath.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan comprising:

a ceiling fan motor having a rotatable flywheel with a top and a bottom, and an outer perimeter side wall perpendicular to the top and the bottom of the flywheel;

a plurality of slots through the outer perimeter side wall of the flywheel;

a plurality of fan blades having root ends; and catch members adjacent to each of the slots for allowing the root ends of the blades to be automatically locked to the rotatable flywheel by sliding the root ends of the blades through the slots of the rotatable flywheel toward the motor, wherein the catch members include:

sheaths attached adjacent to each of the slots, wherein the root ends of the blades become locked to the sheaths when the root ends of the blades are inserted into each of the slots, and locked in place by the catch members.

2. The ceiling fan of claim 1, wherein the root ends of each blade include a groove for catching into a raised ridge on an inner surface of each sheath.

3. The ceiling fan of claim 2, wherein each sheath includes a first free end and a second free end separated by one another by a hinge portion, wherein pinching and bending the first free end and the second free end together separates the raised ridge from the groove, and allows the blade to be released and freely pulled out from the slot.

4. The ceiling fan of claim 1, wherein the root ends of each blade include a raised ridge for catching into a groove on an inner surface of each sheath.

5. The ceiling fan of claim 4, wherein each sheath includes a first free end and a second free end separated by one another by a hinge portion, wherein pinching and bending the first free end and the second free end together separates the raised ridge from the groove, and allows the blade to be released and freely pulled out from the slot.

6. The ceiling fan of claim 2, wherein each sheath includes a fixed edge and a free end, wherein bending the free end removes the raised ridge from the groove, and allows the blade to be released and freely pulled out from the slot.

7. The ceiling fan of claim 5, wherein each sheath includes a fixed edge and a free end, wherein bending the free end removes the raised ridge from the groove, and allows the blade to be released and freely pulled out from the slot.

8. The ceiling fan of claim 6, wherein the free end includes a tab.

9. The ceiling fan of claim 7, wherein the free end includes a tab.

10. The ceiling fan of claim 1, wherein each sheath is fixably attached to the flywheel during manufacturing of the ceiling fan.

11. The ceiling fan of claim 10, wherein each sheath is attached to the flywheel by a screw fastener.

12. The ceiling fan of claim 1, further comprising a longitudinal groove that is slidable into a longitudinal ridge which prevents installers from installing the blades upside down.

13. A method of assembling blades to a ceiling fan, comprising the steps of:

providing a ceiling fan motor with a rotatable flywheel with a top and a bottom, and an outer perimeter side wall perpendicular to the top and the bottom of the flywheel;

providing a plurality of slots through the outer side wall of the flywheel;

slidably inserting root ends of the blades into the slots toward the motor; and snapably locking the blades to the flywheel by snapping catch members, into grooves wherein the locking step includes the steps of:

providing a groove on each root end of the blades;

providing a raised ridge on an inner surface adjacent to each of the slots; and snapably locking the raised ridge into each groove after pushing the root ends of the blades through the slots.

14. The method of claim 13, further comprising the step of:

releasing the blades from the slots by bending a free end portion of sheaths attached to the fly wheel which removes the raised ridge from the groove, and allows the blades to be freely pulled out from the slots.

15. The method of claim 14, further comprising the step of:

attaching the sheaths to the fly wheel by screws.

16. The method of claim 13, further comprising the step of:

releasing the blades from the slots by pinching a first free end and a second free end together on opposite sides of a hinge portion, which separates the raised ridge from the groove, and allows the blades to be released and freely pulled out from the slots.

17. The method of claim 13, further comprising the steps of:

providing a tab; and bending the tab to separate the raised ridge from the groove.

18. The method of claim 13, further comprising the steps of:

providing two tabs separated from one another by a hinge portion;

providing two raised ridges and two grooves; and pinching the two tabs together to separate the raised ridges from the grooves.

19. A method of assembling blades to a ceiling fan, comprising the steps of:

providing a ceiling fan motor with a rotatable flywheel with a top and a bottom, and an outer perimeter side wall perpendicular to the top and the bottom of the flywheel;

providing a plurality of slots through the outer side wall of the flywheel;

slidably inserting root ends of the blades into the slots toward the motor; and snapably locking the blades to the flywheel by snapping catch members into grooves, wherein the locking step includes the steps of:

providing a groove on an inner surface adjacent to each of the slots;

providing a raised ridge on each root end of the blades; and snapably locking the raised ridge into each groove after pushing the root ends of the blades through the slots.

20. The method of claim 19, further comprising the step of:

releasing the blades from the slots by bending a free end portion of sheaths attached to the fly wheel which removes the raised ridge from the groove, and allows the blades to be freely pulled out from the slots.

21. The method of claim 20, further comprising the step of:

attaching the sheaths to the fly wheel by screws.

22. The method of claim 19, further comprising the step of:

releasing the blades from the slots by pinching a first free end and a second free end together on opposite sides of a hinge portion, which separates the raised ridge from the groove, and allows the blades to be released and freely pulled out from the slots.

23. The method of claim 19, further comprising the steps of:

providing a tab; and a raised ridge on an inner surface adjacent to each of the slots, wherein the blades are attached to the flywheel when the root ends of the blades are inserted into the slots and each raised ridge snapably locks into each groove.

24. The method of claim 19, further comprising the steps of:

providing two tabs separated from one another by a hinge portion;

providing two raised ridges and two grooves; and pinching the two tabs together to separate the raised ridges from the grooves.

25. A ceiling fan comprising:

a ceiling fan motor having a rotatable flywheel with a top and a bottom, and an outer perimeter side wall perpendicular to the top and the bottom of the flywheel;

a plurality of slots through the outer perimeter side wall of the flywheel;

a plurality of fan blades having root ends; and a groove on each root end of the blades;

a raised ridge on an inner surface adjacent to each of the slots, wherein the blades are attached to the flywheel when the root ends of the blades are inserted into the slots and each raised ridge snapably locks into each grove.

26. A ceiling fan comprising:

a ceiling fan motor having a rotatable flywheel with a top and a bottom, and an outer perimeter side wall perpendicular to the top and the bottom of the flywheel;

a plurality of slots through the outer perimeter side wall of the flywheel;

a plurality of fan blades having root ends; and a groove on an inner surface adjacent to each of the slots;

a raised ridge on each root end of the blades, wherein the blades are attached to the flywheel when the root ends of the blades are inserted into the slots and each raised ridge snapably locks into each groove; bending the tab to separate the raised ridge from the groove.

* * * * *